US007252484B1

(12) United States Patent
Crumpley

(10) Patent No.: US 7,252,484 B1
(45) Date of Patent: Aug. 7, 2007

(54) CAMOUFLAGED INFLATION DEVICE

(76) Inventor: Robert D. Crumpley, 29030 N. 50th Pl., Cave Creek, AZ (US) 85331

( * ) Notice: Subject to any disclaimer, the term of this patent is extended or adjusted under 35 U.S.C. 154(b) by 658 days.

(21) Appl. No.: 10/661,422

(22) Filed: Sep. 15, 2003

(51) Int. Cl.
*F04B 53/00* (2006.01)

(52) U.S. Cl. ..... 417/234; 417/410.1

(58) Field of Classification Search ..... 417/234, 417/410.1
See application file for complete search history.

(56) References Cited

U.S. PATENT DOCUMENTS 1,647,818 A * 11/1927 Semak ..... 417/234
2,285,215 A * 6/1942 Lotz ..... 417/234
4,021,131 A 5/1977 Bakken et al.
4,187,058 A 2/1980 Fish
4,483,664 A * 11/1984 Armbruster ..... 417/234
5,156,530 A 10/1992 Rutschle
5,173,033 A * 12/1992 Adahan ..... 417/234
5,399,072 A 3/1995 Westphal
5,535,808 A * 7/1996 Idesis et al. ..... 160/370.22
5,571,409 A * 11/1996 Scarborough ..... 210/167.25
6,094,773 A * 8/2000 Krentz et al. ..... 417/234
6,179,218 B1 * 1/2001 Gates ..... 417/423.3
6,248,411 B1 6/2001 Warfel
6,474,373 B1 11/2002 Sejnowski

FOREIGN PATENT DOCUMENTS

JP 2000-316385 A * 11/2000

* cited by examiner

*Primary Examiner*—Michael Koczo, Jr.

(57) ABSTRACT

A camouflaged inflation device for inflating pool toys and rafts includes a housing that includes a bottom wall, a top wall and a peripheral wall that is attached to and extends downwardly from the top wall. The peripheral wall has a bottom edge having a peripheral lip thereon for receiving a peripheral edge of the bottom wall. The housing is camouflaged to appear as a poolside object. An air compressor is mounted on the bottom wall for providing pressurized air. An air supply hose has a first end fluidly coupled to the air compressor and a second end extending outwardly through a first aperture in the peripheral wall. Pressurized air supplied by the air compressor flows outwardly through the second end of the hose.

1 Claim, 4 Drawing Sheets

CAMOUFLAGED INFLATION DEVICE

BACKGROUND OF THE INVENTION

1. Field of the Invention

The present invention relates to inflation devices and more particularly pertains to a new inflation device for providing a poolside device for inflating toys, rafts and the like.

2. Description of the Prior Art

The use of inflation devices is known in the prior art. While these devices fulfill their respective, particular objectives and requirements, the need remains for a device that is sufficiently camouflaged as different object so that it does not make an unseemly sight when positioned in an easily accessible location, particularly by a pool so that it may be used for inflating rafts and inflatable toys.

SUMMARY OF THE INVENTION

The present invention meets the needs presented above by a housing that includes a bottom wall, a top wall and a peripheral wall that is attached to and extends downwardly from the top wall. The peripheral wall has a bottom edge having a peripheral lip thereon for receiving a peripheral edge of the bottom wall. The housing is camouflaged to appear as a poolside object. An air compressor is mounted on the bottom wall for providing pressurized air. An air supply hose has a first end fluidly coupled to the air compressor and a second end extending outwardly through a first aperture in the peripheral wall. Pressurized air supplied by the air compressor flows outwardly through the second end of the hose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
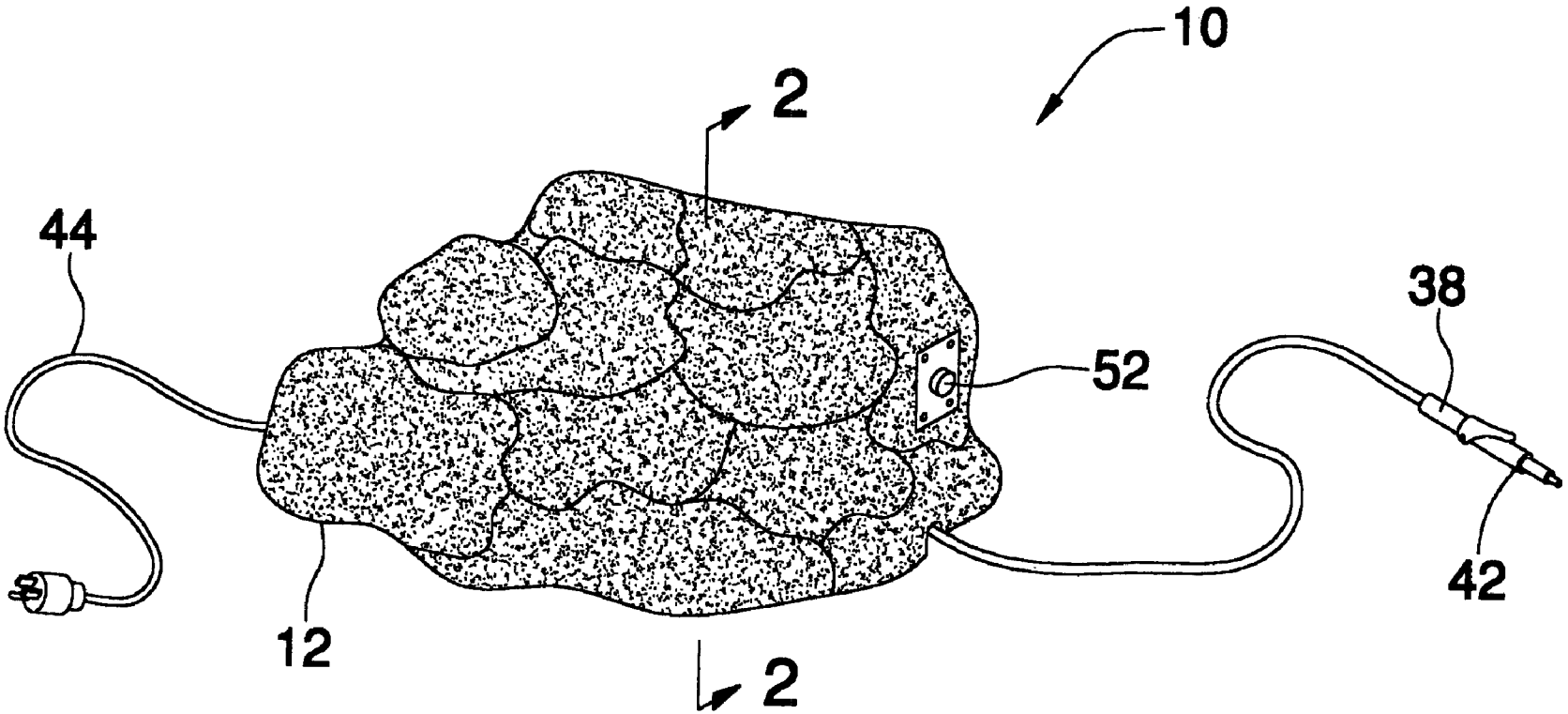
FIG. 1 is a schematic perspective view of a camouflaged inflation device according to the present invention.
Figure 2:
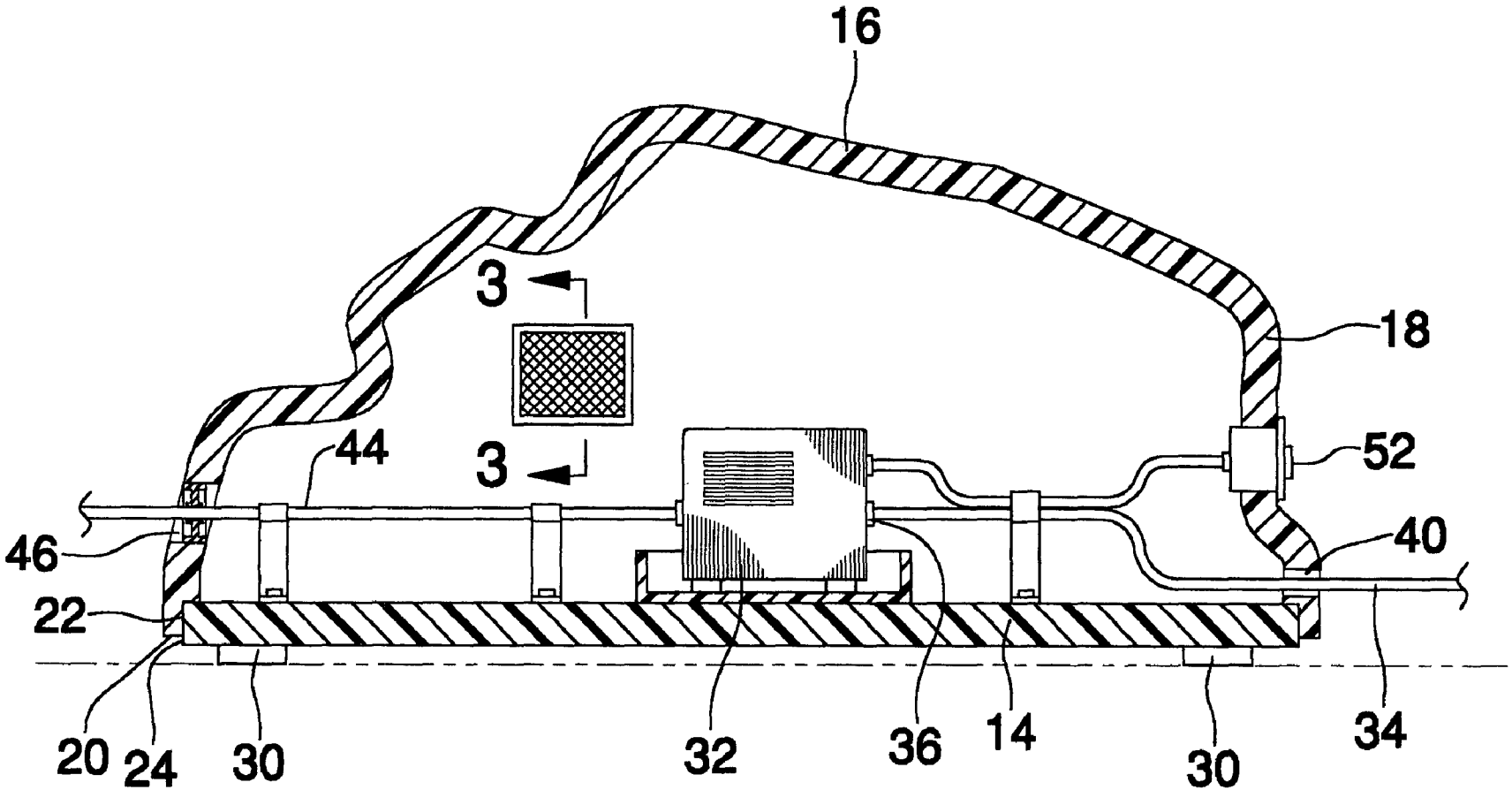
FIG. 2 is a schematic cross-sectional view taken along line 2-2 of FIG. 1 of the present invention.
Figure 3:
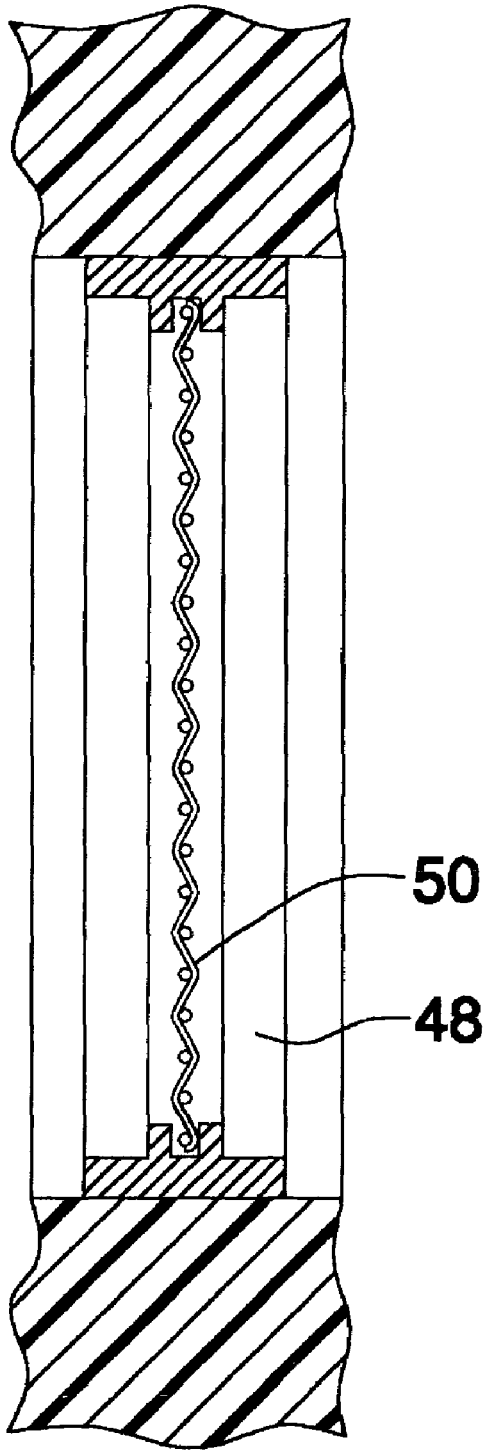
FIG. 3 is a schematic cross-sectional view taken along line 3-3 of FIG. 2 of the present invention.
Figure 4:
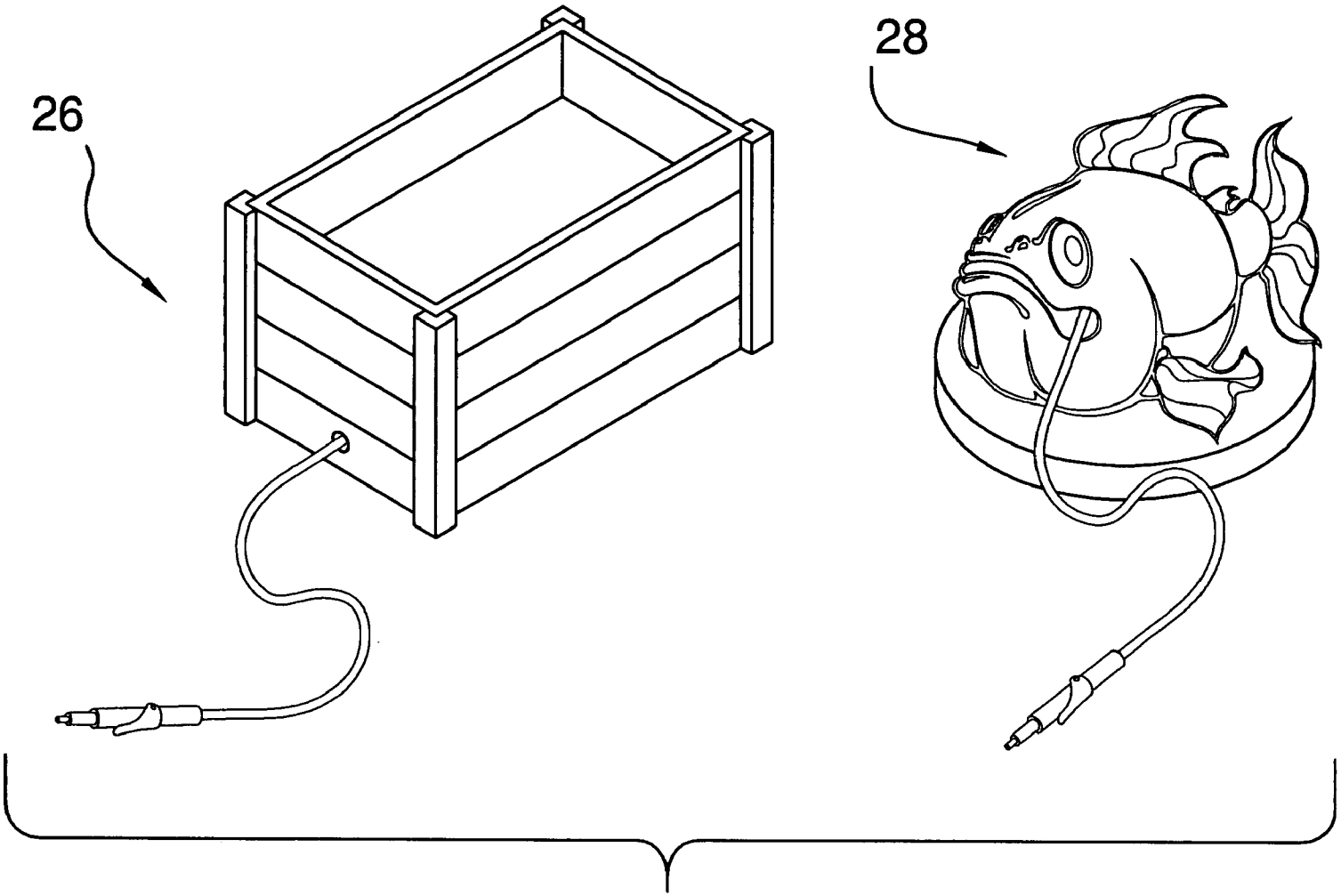
FIG. 4 is a schematic perspective view of alternate embodiments of the present invention.

With reference now to the drawings, and in particular to FIGS. 1 through 4 thereof, a new inflation device embodying the principles and concepts of the present invention and generally designated by the reference numeral 10 will be described.

As best illustrated in FIGS. 1 through 4, the camouflaged inflation device 10 generally comprises a housing 12 that includes a bottom wall 14 and a top wall 16. A peripheral wall 18 is attached to and extends downwardly from the top wall 16. The peripheral wall 18 has a bottom edge 20 having a peripheral lip 22 thereon for receiving a peripheral edge 24 of the bottom wall 14. The peripheral lip 22 is not attached to the bottom wall 14 so that it may be easily removed for reasons which will become obvious below. The housing 12 is camouflaged to appear as a poolside object. Preferably, the top 16 and peripheral 18 walls have an irregular shape and resemble a boulder. Alternatively, the housing 12 may be shaped like a planter 26 or an aquatic animal 28 such as a fish, dolphin or the like. Preferably, the housing 12 is constructed of a plastic material. A plurality of feet 30 is attached to a bottom side of the bottom wall 14. The feet 30 are preferably each comprised of an elastomeric material.

An air compressor 32 is mounted on the bottom wall 14 for providing pressurized air. An air supply hose 34 has a first end 36 fluidly coupled to the air compressor 32 and a second end 38 extending outwardly through a first aperture 40 in the peripheral wall 18. The first aperture 40 is positioned generally adjacent to the bottom edge 20. Pressurized air supplied by the air compressor 32 flows outwardly through the second end 38 of the hose 34. A valve 42 for selectively opening or closing the hose 34 is fluidly coupled to the second end 38 of the hose 34. Though the air compressor 32 may include gas powered air compressors, it is preferred that the air compressor 32 be electrically powered and a power supply cord 44 is electrically coupled to the air compressor 32 for supplying electricity to the air compressor 32. The power supply cord 44 extends through a second aperture 46 in the peripheral wall 18. The first aperture 40 is positioned generally opposite with respect to the second aperture 46 in the peripheral wall 18. A window 48 extends through the peripheral wall 18 to provide an air inlet for the air compressor 32. A mesh screen 50 is positioned in the window 48. An actuator 52 for selectively turning the air compressor 32 on or off is mounted on the exterior surface of the peripheral wall 18 and is operationally coupled to the air compressor 32.

In use, the device 10 is positioned adjacent to a pool for supplying air for inflatable rafts and inflatable toys. The device 10 is camouflaged such that it looks a natural poolside decorative item while having the practical function of supplying compressed air as needed. The elastomeric feet 30 help to lessen vibration of the housing 12 which in turn reduces noise when the device 10 is used. By not attaching the peripheral wall 18 to the bottom wall 14, the user may easily remove the peripheral wall 18 to clean an interior of the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy inflating and planter combination device comprising:

a housing including a bottom wall, a top wall and a peripheral wall being attached to and extending downwardly and upwardly from said top wall, a plant receiving space being defined by said top wall and an upper portion of said peripheral wall extending upwardly from said top wall, wherein said top wall defines a bottom surface of said plant receiving space;

an air compressor being mounted on said bottom wall for providing pressurized air;

an air supply hose having a first end fluidly coupled to said air compressor and a second end extending outwardly through a first aperture in said peripheral wall, said first aperture being positioned generally adjacent to said bottom edge, wherein pressurized air supplied by said air compressor flows outwardly through said second end of said hose;

a valve for selectively opening or closing said hose being fluidly coupled to said second end of said hose;

a power supply cord being electrically coupled to said air compressor for supplying electricity to said air compressor, said power supply cord extending through a second aperture in said peripheral wall, said first aperture being positioned generally opposite with respect to said second aperture in said peripheral wall;

a window extending through said peripheral wall, a mesh screen being positioned in said window;

an actuator for selectively turning said air compressor on or off being mounted on the exterior surface of said peripheral wall and being operationally coupled to said air compressor; and a plurality of feet being attached to a bottom side of said bottom wall, each of said feet comprising an elastomeric material.

* * * * *